United States Patent [19]

Johannes

[11] 3,969,167

[45] July 13, 1976

[54] NITROCELLULOSE EXPLOSIVE PROCESS INVOLVING A KETONE

[76] Inventor: Gerald E. Johannes, 565 Frank Ave., SW., Huron, S. Dak. 57350

[22] Filed: Dec. 30, 1974

[21] Appl. No.: 537,531

Related U.S. Application Data

[63] Continuation of Ser. No. 341,355, March 15, 1973, abandoned, and a continuation of Ser. No. 261,317, June 9, 1972, abandoned.

[52] U.S. Cl. ..... 149/38; 149/43; 149/49; 149/50; 149/63; 149/64; 149/65; 149/75; 149/79; 149/98; 149/100

[51] Int. Cl.[2] ..... C06B 33/08

[58] Field of Search ..... 149/98, 63, 100, 64, 149/49, 38, 65, 50, 43, 44

[56] References Cited

UNITED STATES PATENTS 3,447,983 6/1969 Camp ..... 149/100 X

*Primary Examiner*—Stephen J. Lechert, Jr.
*Attorney, Agent, or Firm*—Strauch, Nolan, Neale, Nies & Kurz

[57] ABSTRACT

High explosives and propellants made by combining a nitrated cellulose with a ketone or ketone derivative.

7 Claims, No Drawings

NITROCELLULOSE EXPLOSIVE PROCESS INVOLVING A KETONE

This is a continuation of application Ser. No. 341,355, filed Mar. 15, 1973 and a continuation of Ser. No. 261,317, filed 6/9/72, both abandoned.

This invention relates to explosives and, more specifically, to novel, improved explosive compositions[1] which have a number of advantages over those heretofore available.

[1] The term "explosive composition" is used generically herein to embrace formulations which deflagrate such as propellants and formulations which detonate such as high explosives.

The basic compositions I have invented are (apparently) chemically reacted combinations of a single or double base nitrocellulose[2] and a ketone of the formula

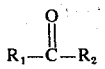

where $R_1$ and $R_2$ are each $C_1$–$C_{14}$ or a derivative thereof such as Barthol, which is a commercially available solvent and dope thinner. The compositions contain from 1 to 100 measured parts[3] of ketone constituent per 8 measured parts of nitrocellulose.

[2] The single base nitrocelluloses with which the present invention is concerned are those having upwards of 12 percent nitrogen. The double base nitrocelluloses of concern are those containing 15 to 20 percent nitroglycerin in combination with a nitrocelluilose as just described.

[3] By the term "measured parts" as used herein is meant parts by volume.

Virtually any single base or double base nitrocellulose may be employed in making my novel compositions. Also, mixtures of single base and double base nitrocellulose may be employed.

The procedure by which the novel compositions of the present invention are made will depend to some extent upon the character of the nitrocellulosic constituent employed and the properties wanted in the final composition. Thus, the nitrocellulose can in some cases be combined directly with the ketone or ketone derivative. Typically, however, from 1 to 100 measured parts of a $C_1$–$C_6$ alcohol per 8 measured parts of nitrocellulose[4] will first be added to the nitrocellulose at room temperature and allowed to stand to dissolve from the nitrocellulose any coating it may have. Thereafter, the excess alcohol may be poured off and the ketone constituent added.[5] This constituent is mixed with the treated nitrocellulose at room temperature in a vessel of polyethylene or other material which is inert with respect to its contents. The addition of the ketone constituent is accompanied by an increase in the temperature of the mixture (typically on the order of 25°C)[6] which would indicate that exothermic chemical reactions are taking place. At the same time the nitrocellulose decomposes into a stringy mass and increases in bulk.

[4] In parts by weight the explosive compositions of the present invention will typically include from 1 to 100 parts of the ketone constituent and, optionally, from 1 to 100 parts of alcohol per 100 parts of nitrocellulose.

[5] I have also made explosive compositions in accord with the present invention in which neither the alcohol nor the coating freed from the nitrocellulose were removed before the ketone constituent was added.

[6] The temperature rise and ultimately the characteristics of the final product can be controlled by varying the amount of alcohol present when the ketone constituent is added. In tests in which all of the alcohol was first removed, temperature rises as high as 50°C. were observed.

The consistency of the material continues to change as the stirring is continued. At the end of approximately one hour, it becomes a soft, plastic, homogeneous mass of reacted material which can be molded, extruded, etc. The material can be retained in this form indefinitely by keeping it in an oxygen-free environment as with appropriate packaging. This makes my novel compositions useful as plastic explosives and also permits them to be formed into propellant grains and other shapes long after they are initially made.

If the plastic material is converted into granules, pellets, etc., they can be dried to a very high strength simply by exposure to air at room temperature.[7] Or, to speed the drying process, air heated to a temperature of not more than 300°F. can be circulated into heat transfer relationship with the explosive composition.

[7] Air drying at ambient temperatures will typically take from ½ to 48 hours depending upon the viscosity of the composition, its form, the particular constituents in the composition, etc.

Infrared and ultraviolet drying can also be employed although care must be exercised to insure that the flash point of the material being dried (typically at least 550°F.) is not exceeded. This may require that the radiant source be placed up to two feet away from the drying material.

Before it is dried, the composition can be washed in hot water, if desired, to remove any residues which may be present. This step is normally optional, however, and can generally be omitted without adverse effects on the final composition.

If stirring is continued for periods on the order of 24 hours, the nitrocellulosic material will assume a syrupy, laquerlike consistency (the viscosity can further be controlled by the amount of ketone used) and can be sprayed, cast onto a glass or plastic surface to form a sheet or film, or cast into blocks, etc. or into shells, bomb casings, or the like. The composition can then harden to a solid by exposure to air room temperature or heated air or by infrared or ultraviolet radiation like those more viscous or plastic forms of the composition. The less viscous formulations can also be kept in their unhardened state indefinitely by keeping them in an airtight container.

One of the major advantages of the present invention is its versatility. My novel explosive compositions can be made in a variety of physical forms ranging from plastic through granular and extruded forms to cast configurations. Also, the ignition and detonation rates can be varied over a wide range, making various forms of my invention usable as propellants, as high explosives, and as pyrotechnics.

Following the process outlined above will produce compositions useful as propellants.[8] The characteristics of the propellant can be varied to optimize its performance in a given application by a variety of techniques. One variable is of course the nitrocellulosic material which is employed. Variations in ignition rates can be obtained by employing double as opposed to single base nitrocelluloses, coated rather than uncoated materials, etc.

[8] Propellants in accord with the present invention can be ignited with conventional primers, by electric sparks, by air jets as in the Daisy-Heddon caseless ammunition gun, etc.

Variations in ignition rates can also be obtained by using a particular alcohol or by altering the amount of alcohol added to the nitrocellulose or the time it remains in contact with the nitrocellulose (I have satisfactorily varied this time from approximately 95 seconds to 48 hours) as well as by altogether omitting the step of removing the coating from coated nitrocelluloses before the ketone constituent is combined with the nitrocellulose.

Further, as suggested above, the particular ketone constituent employed as well as the amount of this compound can be varied to change the ignition rate of the end product.

Materials made as described above can also be used as high explosives although they are relatively insensitive and must be detonated by a Composition B, Titan, or other high energy booster. Commonly, therefore, I modify the basic ketone/nitrocellulose composition if it is to be used as a high explosive One novel and important manner in which this may be done is to add from ¼ to 2 measured parts of diethyl ether per 8 measured parts of nitrocellulose to the nitrocellulose after the addition of the ketone constituent. The resulting compositions can be detonated by a blasting cap or detonating cord and have great explosive power.

Useful high explosives may also be made by mixing TNT (trinitrotoluene) with the compositions described above. The proportions of the two constituents can be varied although I typically use equal parts of them. Also, other explosives can be used instead of or in combination with the TNT. These include pentolite, picric acid, and its derivatives, derivatives of TNT, etc. The explosive or explosives may be used in amounts ranging from 1 to 100 percent based on the weight of the composition of the present invention.

Other additives that can be incorporated in my novel compositions to produce useful high explosives are powdered metals including zinc, aluminum, magnesium, and bronze and oxidizers including ammonium and alkali metal chlorates and nitrates such as potassium chlorate and ammonium, potassium, and sodium nitrates. Such additives can be employed in various combinations and amounts ranging from 1 to 100 percent by weight of the basic composition and can also be used in admixture with TNT or other high explosives.

Another important advantage of my novel compositions is that they have a high strength factor when hardened and do not crumble or otherwise disintegrate like many propellants and high explosives. This novel property makes them unusually valuable in caseless ammunition and similar applications.

Yet another important advantage of the present invention is that my novel compositions are not hygroscopic, have a high degree of resistance to moisture, and can indeed be made entirely waterproof, if desired. These properties are advantageous in many applications of the invention, but are particularly important in that they make my compositions particularly satisfactory as underwater explosives and in adverse weather conditions.

A further important advantage of my novel compositions is that they leave virtually no residue (less then 0.01 percent) when ignited or detonated, which clearly distinguishes them from other nitrocellulose propellants and explosives. This lack of residue is significant for several reasons.

First, the lack of residue is because my compositions are very efficient; that is, they have a greater energy release per unit weight than other nitrocelluloses and conventional explosives, which typically liberate only 50–60 of thee theoretically available energy when they are detonated. Also, the lack of residue reduces the amount of cleaning and prolongs the life of gun barrels, especially those of larger calibers.[9] Further, the lack of residue means that there is no smoke when the composition deflagrates or detonates, a property which is important in military applications of the invention and which distinguishes my novel compositions from TNT, Composition B, Composition C4, etc.

[9] Longer gun barrel like is attributable to the reduced erosion appurtenant to the lack of residue.

As suggested above, another significant advantage of my novel high explosive compositions is that they are relatively insensitive although they can be readily detonated (for example, they are not detonated by small arms fire). These compositions are also not susceptible to sympathetic detonation. They are, moreover, stable and do not deteriorate in storage unlike conventional explosives such as dynamites, nitroglycerins, TNT, and others which become unstable over a period of time; with temperature changes;[10] and, also, if they freeze. My novel compositions are consequently much safer to use and store.

[10] Explosive compositions as described herein have been held at temperatures as low as −10°F and also submerged in near boiling and freezing water for extended periods of time without loss of stability or energy release.

A related and also important advantage is that, unlike conventional explosives, the compositions disclosed herein are not susceptible to partial detonation. This is also of obvious importance from the safety point-of-view. A further related advantage is that my novel compositions do not present the fire hazard of conventional explosives because of their insensitivity to temperature changes.

Also, the manufacture of my novel compositions does not involve the presence or formation of any unstable compounds or complexes or any highly exothermic reactions. Consequently, they can be produced without the hazards associated with the manufacture of conventional high explosives.

My novel compositions also have the advantage that their properties can be tailored by the use of numerous techniques to the optimum required for different applications. For example, if they are made up in granular form with propellant-type characteristics, they can be coated with graphite and/or other deterrents to control their burning rates for munitions applications. Or up to 40 parts by weight of glycerin may be mixed with 100 parts of such a composition while it is in a plastic state or after it has been converted to a granular form and dried, resulting in a formulation which is a novel and superior rocket propellant in that it has a higher energy release than those of conventional character and which can be readily molded to form.

Yet another important advantage of my novel compositions is that they are relatively inexpensive to manufacture and store. The constituents are relatively inexpensive, and the manufacturing process does not require the customary elaborate safety precautions as mentioned above. Similarly, elaborate storage procedures are not needed because of the insensitiveness to large temperature changes, sympathetic detonation, etc. possessed by such compositions and their high moisture resistance.

A still further advantage of my invention is that the compositions do not react with or adhere to polyethylene or similar polymers. This also contributes to ease of manufacture and packaging.

From the foregoing it will be apparent that the novel propellant and high explosive compositions I have invented are fundamentally different from conventional high explosives and from conventional nitrocellulose-based propellants. They are also markedly different from black powder substitutes such as the nitrocellulose/charcoal binder/oxidizer formulation described in U.S. Pat. No. 3,473,982 issued October 21, 1969, to Herzog. The Herzog composition is corrosive and unstable and would produce rapid erosion of gun barrels. Also, it would not be smokeless and would not have a high energy release factor. Furthermore, the disclosed formulations are not usable as anything but propellants; they are not high explosives.

It will be readily apparent from the preceding that one primary object of the present invention resides in the provision of novel, improved explosive compositions of the propellant, pyrotechnic, and high explosive types.

Other important but more specific objects of the invention reside in the provision of explosive compositions in accord with the preceding object:

1. which can be easily and economically manufactured and stored.
2. which do not present a high hazard in the manufacturing process or in storage.
3. which, in conjunction with the preceding objects, present a much lower fire hazard than conventional high explosives.
4. which, in conjunction with the preceding object, are made from relative non-hazardous materials by a process which does not involve the formation of dangerous intermediates or violent chemical reactions.
5. which, in conjunction with object No. (2), are insensitive though easily detonated, not susceptible to sympathetic detonation, and stable, even under wide variations in temperature and in the presence of moisture.
6. which can be prepared in a wide variety of physical forms.
7. which are water resistant or waterproof and are therefore well-suited for applications where moisture or water are present such as underwater blasting and demolition and for use in adverse weather conditions.
8. which can be readily modified to optimize their properties for different applications.
9. which can be stored indefinitely in a liquid or plastic form.
10. which are highly efficient.
11. which leave only a negligible residue of non-corrosive character and which cause only minimal erosion of gun barrels and the like when used as propellants.
12. which have significantly greater physical strength than typical conventional explosives.
13. which are not susceptible to partial detonation.
14. which have various combinations of the foregoing attributes.

Another important and primary object of the present invention resides in the provision of novel, improved processes for making explosive compositions having the characteristics described in the preceding objects and various combinations of such characteristics.

Other important and novel objects and advantages as well as further significant features of my invention will be apparent from the foregoing description of it, from the appended claims, and from the following examples, which are intended to further clarify the nature of the invention, but not to limit its scope.

EXAMPLE I

A propellant for caseless ammunition was made by adding 125 mls of ethyl alcohol to 8 ounces of a double base nitrocellulose[11] with stirring at room temperature. The mixture was allowed to stand for 95 seconds and the excess alcohol (approximately one-half of the original amount) was then poured off.

[11] DuPont 4831

The nitrocellulose with the remaining alcohol was transferred to a polyethylene reactor equipped with an agitator. One hundred twenty-five mls of dimethyl ketone was added and the reactor sealed to isolate it from the ambient surroundings.

The agitator was then started with the reactor and contents at room temperature. The temperature of the mixture rose rapidly to 25°C. above room temperature, remained at this temperature for a short period of time, and then returned slowly to room temperature.

Stirring was continued for one hour with the nitrocellulose mixture first becoming stringy and fibrous and then turning into a plastic, homogeneous mass. At the end of the one hour period, portions of the resulting composition were transferred to 0.361 inch diameter molds. A pressure of 35,000 pounds was applied for 95 seconds with a ram and piston.

This produced pellets which were removed from the molds, dried, and attached to the bases of 9 mm bullets. The bullets were fired through an eight inch test barrel.

The mean muzzle velocity of the rounds which ignited was 1048 feet per second, a surprisingly high velocity for caseless ammunition. None of the propellant pellets suffered any physical deterioration while being handled.

EXAMPLE II

In a procedure similar to that described in Example I, one pint of ethanol was mixed with one pound of nitrocellulose.[12] The mixture was allowed to stand for four hours. One-half of the mixture was then added with stirring to one-half pint of dimethyl ketone and the stirring continued until a dark, viscous mixture formed. The remaining nitrocellulose/alcohol mixture was then added with stirring, producing a substance with the consistency of a commercial laquer which could not be detonated with a blasting cap or ignited by a match.

[12] DuPont 4831

Samples of the laquerlike substance were exposed to air at approximately room temperature. After approximately five minutes, the composition had assumed a plastic or putty-like consistency and could readily be extruded, molded, and otherwise formed into different shapes. At this stage the composition would burn slowly but still could not be detonated with a blasting cap.

EXAMPLE III

Pellets of a smaller diameter were made in the manner described in Example I from the same composition. These were attached to 0.22 caliber projectiles; and the rounds were fired through a Daisy-Heddon caseless ammunition gun. Muzzle velocities of 1,154 feet per second were obtained for pellets having a weight of ¼ mg.[13] This is far above the velocity which the manufacturer's ammunition for this weapon produces.

[13] Propellants of the type I have invented will typically weigh on the order of 6 grains per cubic centimeter.

Similar pellets having weights of 1 ¼ and 1 ½ mg, respectively, produced muzzle velocities of 1450 and 1700 plus feet per second. The weapon, however, proved incapable of withstanding repeated firings of the latter loads.

EXAMPLE IV

To demonstrate the outstanding resistance to water possessed by my novel compositions, pellets of the type described in the preceding example were exposed to rain, snow and heat for periods of three and four months. At the ends of these periods the pellets did not exhibit any significant signs of physical deterioration.

The pellets which had been exposed to the elements in the weathering tests were then mated with projectiles and fired through the Daisy-Heddon gun. These rounds produced approximately the same muzzle velocities as the unweathered rounds employed in the test described in Example III.

EXAMPLE V

In a similar test, pellets as described in Example IV were mated with projectiles; and the rounds were then soaked in water for a period of one hour. The rounds were removed, shaken to remove excess water, and fired through the Daisy-Heddon gun. No significant difference in performance was observed.

EXAMPLE VI

A composition as described in Example II was extruded through a die under 3500 psi into flat sheets. These sheets were cut into flakes, producing a propellant which resembled a conventional powder. Ten gauge shells were loaded with 30 grains of this propellant and 1 ⅞ ounces of shot. These rounds produced velocities significantly greater than those obtained from conventional loads.

EXAMPLE VII

A propellant as described in Example II was extruded under 35,000 psi through a die having a 0.067 inch cylindrical opening. The extrusion was cut into pellets weighing 30 grains. Shotshells loaded with these pellets also produced higher velocities than conventional shotshell loads of the same gauge.

EXAMPLE VIII

To further demonstrate the invulnerability to moisture of my novel explosive compositions, a powder as described in Example VI was soaked in water for several hours. The powder was then removed and excess water shaken off. Shells were then loaded with the powder as in the tests discussed in Example VII and the shells fired. There was no discernable deterioration in the performance of the rounds.

In none of the tests described in the preceding eight examples was there any fouling of barrels through which the rounds were fired.

EXAMPLE IX

In yet another test demonstrating the unique water resistance of my novel compositions, a one-pound block of composition prepared as described in Example I and then molded and dried was left outside in an exposed location for an entire winter season. The block was then retrieved and inspected. There was no significant visible sign of deterioration.

The block of explosive was then detonated. It detonated completely and with as much energy release as comparable blocks which had not been exposed to the elements.

EXAMPLE X

As mentioned previously, compositions of the type disclosed herein can be washed to remove residues before they are dried, if desired. Thus, a sample of material prepared as described in Example I was washed with hot water at the rate of one gallon of water per pound of composition to remove excess alcohol and ketone and then dried. The resulting material was similar in appearance to that dried in air without washing except for greater surface porosity; its explosive properties were comparable to those of the unwashed composition.

EXAMPLE XI

As indicated above, one of the important advantages of my novel compositions is that they can be kept in a plastic or even less viscous form for indefinite periods if they are isolated from air. To demonstrate this, a sample of a plastic composition as described in Example I was sealed in an evacuated container to isolate it from air. After 12 months the plasticity of the composition had not changed to a detectable extent. This verifies that the compositions I have invented are useful as plastic explosives and for other applications where it is an advantage to be able to form the propellant or explosive to shape long after the composition has been prepared.

EXAMPLE XII

To demonstrate the preparation of another particularly important form into which compositions of the type disclosed herein may be made a composition according to the present invention was prepared as described in Example I except that the reaction mixture was stirred for two hours and the amount of acetone was increased to 1000 mls. At the end of the two hour period the nitrocellulose/alcohol/ketone composition had the consistency of a commercial laquer.

A portion of the composition was poured onto a polyethylene plate. A second sheet of polyethylene was pressed on the explosive composition to make its thickness more uniform; and the composition was allowed to harden. The resulting film or sheet was released from the plate by contacting it with steam (hot water may also be used as a release agent).

This sheet type propellant is useful in conventional munitions and, especially, in rocket motors and mortar ammunition.

EXAMPLE XIII

Another technique which can be used for forming compositions of the type described in the preceding example into usable configurations is spraying. A sample of the liquid composition was sprayed into air at high pressure (500 psi). The liquid dried upon contacting the air, forming a fine grain powder with irregularly shaped particles which are useful for a variety of purposes.

EXAMPLE XIV

A high performance solid rocket propellant can be made by mixing 40 parts by weight of glycerin with 100 parts by weight of a plastic explosive composition as described in Example XIII, molding the mixture into the desired configuration, and allowing the mixture to harden. The solid propellant produced gas pressures of 50,000 psi, well above those which can be obtained from conventional solid rocket propellants.

EXAMPLE XV

As a variation of the technique described in Example XIII, the liquid composition can be dropped through a screen into air. The result will be spherical particles; i.e., a ball type powder which can be used in smaller caliber munitions typically with a deterrent coating to control its burning rate.

EXAMPLE XVI

To demonstrate the unusually high efficiency of my novel compositions as well as their utility as underwater explosives, one and one-quarter pounds of composition prepared as described in Example I was molded into a block and allowed to harden. An 18 inch deep hole was dug in highly compacted sand in a location in which ten inches of water was standing. The charge was placed in the hole, tamped, and detonated with a high energy booster and an electric blasting cap. The explosion produced a conical crater eight feet in diameter and approximately ten feet deep. The crater was free of debris.

EXAMPLE XVII

As indicated previously, useful high explosives can be made by mixing conventional explosives with my novel compositions. To demonstrate this, equal parts by weight of TNT and a plastic composition prepared as described in Example I were thoroughly mixed. The resulting formulation was readily detonated with a high release of energy by an electrically primed booster.

EXAMPLE XVIII

In a similar test one part by weight of TNT and two parts by weight of powdered aluminum were mixed with ten parts by weight of explosive composition of the formulation of Example I. This resulted in a plastic high explosive which could be molded to shape and then readily detonated with a high energy release.

EXAMPLE XIX

In another test designed to illustrate the versatility of my novel compositions, a slurry type explosive was made by dissolving four measured parts of explosive composition as described in Example I in three measured parts of acetone and blending 1 ½ measured parts of ammonium nitrate into the solution. This explosive was also readily detonated with a high energy, electrically primed booster; the efficiency of the explosive was again high.

EXAMPLE XX

In yet another test dealing with high explosive formulations, twenty parts by weight of powdered aluminum was mixed with a portion of composition in accord with the present invention having a laquerlike consistency. The mixture was blended with a composition prepared as described in Example I in a bladed mixer while the composition was plastic (the explosive composition totalled 80 parts by weight). A noticeable increase in the density of the plastic material occurred.

The mixture was then shaped and hardened by exposing it to air (it will stay plastic if kept in an airtight container). The result was a powerful, waterproof high explosive which was particularly satisfactory for underwater demolitions and blasting.

EXAMPLE XXI

Example XX was repeated using 15 parts by weight of TNT and 15 parts by weight of powdered magnesium in the stead of the aluminum. The resulting explosive proved to be particularly well suited for quarry blasting.

EXAMPLE XXII

Example XX was repeated, substituting 70 parts by weight of nitrocellulosic composition and 30 parts by weight of powdered magnesium for the aluminum. This produced an explosive which is a good general purpose blasting agent.

EXAMPLE XXIII

High explosives which can be detonated by a blasting cap alone (i.e., without a booster) can be made by incorporating ether in the basic compositions of the present invention as discussed above. This was demonstrated by making an explosive in accord with the procedure of Example I except that 4000 mls of acetone and 250 mls of ether were added to the nitrocellulose/alcohol mixture while the nitrocellulose was being dissolved in the ketone. Also, stirring was continued for two hours until the characteristic homogeneous plastic mass formed. The plastic mass was molded to shape and hardened by drying in air. The resulting high explosive could be readily detonated by a number 6 blasting cap and also by detonating cord.[14]

[14] Ether can also in some cases advantageously be added as described above to the nitrocellulose, ketone or ketone derivative mixture (whether or not it contains alcohol, in making my novel explosive compositions of propellant character. The ether will give the grains, pellets, or other forms into which the composition is shaped a roughened surface texture. This facilitates ignition of the propellant as well as uniform burning.

EXAMPLE XXIV

As indicated previously, the removal of the coating from coated nitrocelluloses is not essential in the practice of the present invention. To demonstrate this, one pound of single base nitrocellulose was added with stirring to one-half pint of dimethyl ketone. The stirring was continued for 2 hours, turning the mixture into a gelatinous mass.

The composition was then formed into a propellant as described in Example VI and loaded into shotshells as described in Examples VI and VII, which were fired with similar results.

EXAMPLE XXV

As discussed above, the novel compositions of the present invention may be treated by a number of techniques to impart particular properties to them or to optimize their propeties for specific applications. To illustrate this, high explosives and propellants having a formulation as described in Example I were coated with a material consisting of 25 percent colloidon, 40 percent polyethylene polymer, 15 percent graphite, and 20 percent ether. This coating fireproofed the explosives and propellants.

EXAMPLE XXVI

In a somewhat related test, propellant compositions as described in Examples XIII and XV were coated with a mixture of 74.5 percent diphenylamine, 1 percent dinitrotoluene, and 23.5 percent graphite. This coating controlled the burning rate of the grains and granules and made them burn more uniformly.

EXAMPLE XXVII

To demonstrate that the nature of the ketone constituent employed in my explosive compositions is not critical as long as it is within the class specified above, and to further illustrate the variations in the proportions of the ingredients which will produce satisfactory results, a composition was prepared following generally the procedure described in Examples XVIII et seq. from the following ingredients:

| | |
|---|---|
| Nitrocellulose (DuPont 4831) | 25 Pounds |
| Barthol | 30 Pounds |
| Ammonium Nitrate | 50 pounds |
| Aluminum | 1 pound |

Eighteen pounds of this explosive was detonated at ground level with a high energy booster, producing a fireball approximately 10 feet in diameter and 12 feet high. Shock waves resulting from the detonation were detected at a location approximately 10 miles from the site of the detonation.

This particular type of composition is well suited for military applications. It is, in this regard, much more powerful than widely used military explosives such as Composition B.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. The method of making an explosive composition suitable for use as a high explosive, and having a prolonged shelf life, improved temperature and weather resistance characteristics and improved ballistics properties which includes the steps of combining a nitrocellulose propellant having a nitrogen content of at least 12 percent with a lower alkyl ketone solvent in liquid form, the ratio of ketone to nitrocellulose by volume being in the range of from 1:8 to 100:8; blending said mixture in a non-aqueous environment for on the order of 1–24 hours and until the nitrocellulose dissolves and a homogeneous plastic or fluid mass is obtained; forming said mass to shape; and evaporating excess solvent from the resulting mass.

2. The method of claim 1, wherein the nitrocellulose is in the form of a coated smokeless powder and wherein prior to blending it with the ketone the smokeless powder is contacted with a lower alkyl alcohol in a ratio of 1:100 measured parts of smokeless powder for a period in the range of 95 seconds to 48 hours to remove the coating therefrom.

3. The method of claim 1, together with the step of blending with the nitrocellulose and ketone mixture from 0.5 to 2 measured parts of a lower alkyl ether per 8 measured parts of nitrocellulose to increase the susceptibility to detonation of the resulting explosive composition.

4. The method of claim 1, together with the step of mixing a powdered metal with said material for forming a high explosive, the metal being aluminum, magnesium, zinc, or bronze or a mixture of two or more of the foregoing and the amount of metal employed being from 1 to 100 percent based on the weight of the explosive composition.

5. The method of claim 1, together with the step of mixing an oxidizer with the material to form a high explosive, the amount of oxidizer employed ranging from 1 to 100 percent based on the weight of the explosive composition and the oxidizer being an ammonium or alkali earth chlorate or nitrate or a mixture thereof.

6. The method of claim 1, together with the step of blending a detonatable explosive with said explosive composition to form a high explosive, the amount of detonatable explosive employed ranging from 1 to 100 percent based on the weight of the explosive composition.

7. The method of claim 1, together with the step of blending with the said material from 1 to 100 percent based on the weight of the composition of powdered aluminum, magnesium, zinc, or bronze or a mixture thereof, from 1 to 100 percent based on the weight of the composition of ammonium nitrate, and up to 50 percent based on the weight of the composition of glycerin.

* * * * *